US006179137B1

(12) United States Patent
Talarico

(10) Patent No.: US 6,179,137 B1
(45) Date of Patent: Jan. 30, 2001

(54) STACKABLE CARRYING RACK

(76) Inventor: Joe Talarico, 1241 Beatty Ave., Verdun, Que. (CA), H4H 1Y2

( * ) Notice: Under 35 U.S.C. 154(b), the term of this patent shall be extended for 0 days.

(21) Appl. No.: 09/114,922

(22) Filed: Jul. 14, 1998

Related U.S. Application Data

(60) Provisional application No. 60/053,684, filed on Jul. 24, 1997.

(51) Int. Cl.[7] ..... A47B 57/00; B65D 19/38

(52) U.S. Cl. ..... 211/194; 108/53.3; 108/55.5

(58) Field of Search ..... 211/189, 194, 211/195, 204, 191, 206, 105.1; 312/264, 326–328, 351.1, 351.7; 108/901, 902, 55.5, 53.3, 53.5, 55.1; 220/651–652

(56) References Cited

U.S. PATENT DOCUMENTS

| | | | | |
|---|---|---|---|---|
| Re. 36,153 | * | 3/1999 | Sing | 52/309.9 |
| 408,278 | * | 8/1889 | White | 211/206 |
| 3,045,834 | * | 7/1962 | Seiz | 211/191 |
| 3,224,388 | * | 12/1965 | Skubic | 108/53.5 |
| 3,857,494 | * | 12/1974 | Giardini | 211/194 |
| 3,883,026 | * | 5/1975 | Selz | 211/189 X |
| 3,968,882 | * | 7/1976 | Mello | 211/189 |
| 4,050,606 | * | 9/1977 | Jurasek | 108/55.1 |
| 4,056,195 | * | 11/1977 | Keith | 211/153 |
| 4,199,069 | | 4/1980 | Talarico | 211/194 |
| 4,353,520 | * | 10/1982 | Jansson | 108/55.1 |
| 4,630,739 | * | 12/1986 | Levenberg | 211/189 |
| 4,685,576 | * | 8/1987 | Hobson | 211/189 |
| 4,824,137 | * | 4/1989 | Bolden | 108/55.3 X |
| 5,101,964 | * | 4/1992 | Westphal | 108/55.5 |
| 5,108,141 | * | 4/1992 | Anderson | 211/182 |
| 5,142,994 | * | 9/1992 | Sandberg et al. | 108/53.3 |
| 5,168,817 | * | 12/1992 | Nulle et al. | 108/901 |
| 5,233,931 | * | 8/1993 | McCorkle, Jr. | 108/55.1 |
| 5,263,595 | * | 11/1993 | Holstolsky | 211/126 |
| 5,609,451 | * | 3/1997 | McCorkle, Jr. | 211/194 |
| 5,640,821 | * | 6/1997 | Koch | 52/698 |
| 5,666,886 | * | 9/1997 | Alexander et al. | 108/901 |
| 5,725,137 | * | 3/1998 | MacDonald | 211/206 |

* cited by examiner

*Primary Examiner*—Blair M. Johnson
*Assistant Examiner*—Jennifer E. Novosad
(74) *Attorney, Agent, or Firm*—Mila Shvartsman

(57) ABSTRACT

The present invention relates to a stackable carrying rack comprising a support base provided with support legs extending downwardly from the base and vertical support means mounted on the base and provided for supporting and storing a plurality of items placed in the rack. The support base has a configuration allowing to freely dispense items of smaller dimensions stored inside the rack downwardly though a central opening formed in the base without any obstructions or restrictions. The support base has a generally square configuration formed by side support members, and the central opening has a diamond-shaped configuration formed by reinforcement members extending between each adjacent side support member; the diamond-shaped configuration facilitates free dispensing of items through the central opening. Each of the reinforcement members forms a hypotenuse of a right triangle with respect to the adjacent side support members. The vertical support means comprise vertical support posts mounted on each corner of the support base, where each of the posts is securely locked in a vertical position by means of linking cross-pieces provided to connect each pair of adjacent posts. Each of these linking cross-pieces comprises a sliding binder provided on each end with a square ring adapted to slide over the posts.

12 Claims, 4 Drawing Sheets

STACKABLE CARRYING RACK

This application claims the benefit for provisional application No. 60/053,684 filed on Jul. 24, 1997.

SUMMARY OF THE INVENTION

Broadly, the present invention comprises a stackable carrying rack comprising:

a support base provided with support legs extending downwardly from said base;

vertical support means mounted on said base and provided for supporting and storing a plurality of items placed in said rack;

wherein said support base has a configuration allowing to freely dispense items of smaller dimensions stored inside said rack downwardly though a central opening formed in said base without any obstructions or restrictions. Said support base has a generally square configuration formed by side support members, and wherein said central opening having a diamond-shape configuration formed by reinforcement members extending between each adjacent side support member and wherein said diamond-shaped configuration facilitates free dispensing of items through said central opening.

In another embodiment of the present invention, each of said reinforcement members forms a hypotenuse of a right triangle with respect to said adjacent side support members, and said vertical support means comprise vertical support posts mounted on each corner of said support base, wherein each of said posts is securely locked in a vertical position by means of linking cross-pieces provided to connect each pair of adjacent posts. Each of said linking cross-pieces comprises a sliding binder provided on each end with a square ring adapted to slide over said posts, and each of said linking cross-pieces comprises a locking binder provided with a disk-shaped locking element on each end adapted to be slidably locked within corresponding vertical slots formed near upper ends of said posts.

In yet another embodiment, said vertical support means comprise vertical support posts mounted on each corner of said support base, said posts being securely linked and locked in vertical position by means of side walls mounted between each pair of adjacent posts, wherein said side walls are provided with a locking means adapted to securely hold said walls in vertical position. Said locking means comprises an upper locking means located near upper corners of said side walls and a lower locking means located on lower portions of said side walls. Said upper locking means comprise locking elements having a disk-shaped configuration adapted to be slidably locked within corresponding vertical slots formed near upper ends of said posts, and said lower locking means comprises a retaining bracket adapted to be securely engaged with the corresponding side support member of said support base. Said lower locking means comprise a pair of pins extending downwardly from a lower edge of said side wall, said pins are adapted to be inserted into corresponding openings formed on the side support member of said support base.

In still another embodiment of the present invention, at least one of said side walls has a two-section configuration divided into an upper section and a lower section. Said lower section is slidably mounted on the adjacent posts by means of square rings located on each corner of said lower section and wherein said upper section is mounted on said adjacent posts by means of locking elements located on upper corners of said upper section, said locking elements having a disk-shaped configuration and are slidably locked within corresponding vertical slots formed near upper ends of said posts. Said upper section is securely retained on said lower section by means of at least one retaining bracket adapted to engage an upper edge of said lower section, and said side walls have a screen-shaped configuration. Said support base is further provided with a bottom plate placed over said support base, said bottom plate is adapted to be slidably removed from said base to facilitate free dispensing of items stored in said rack through the central opening formed in said base.

DETAILED DESCRIPTION OF THE PREFERRED EMBODIMENT

Figure 1:
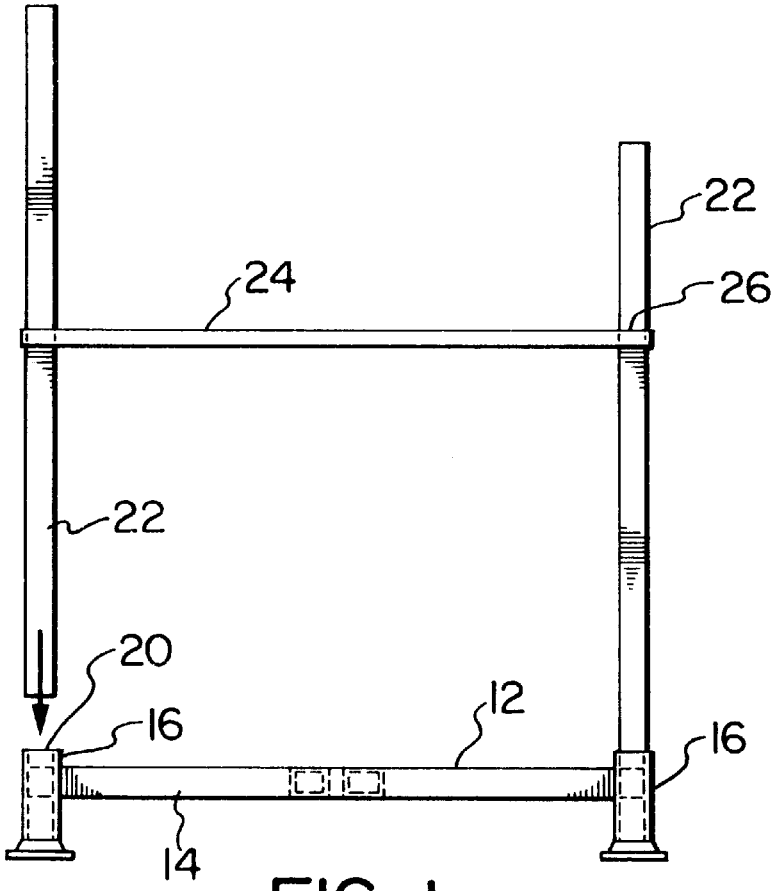
FIG. 1 shows a side view of the first modification of the present invention.
Figure 2:
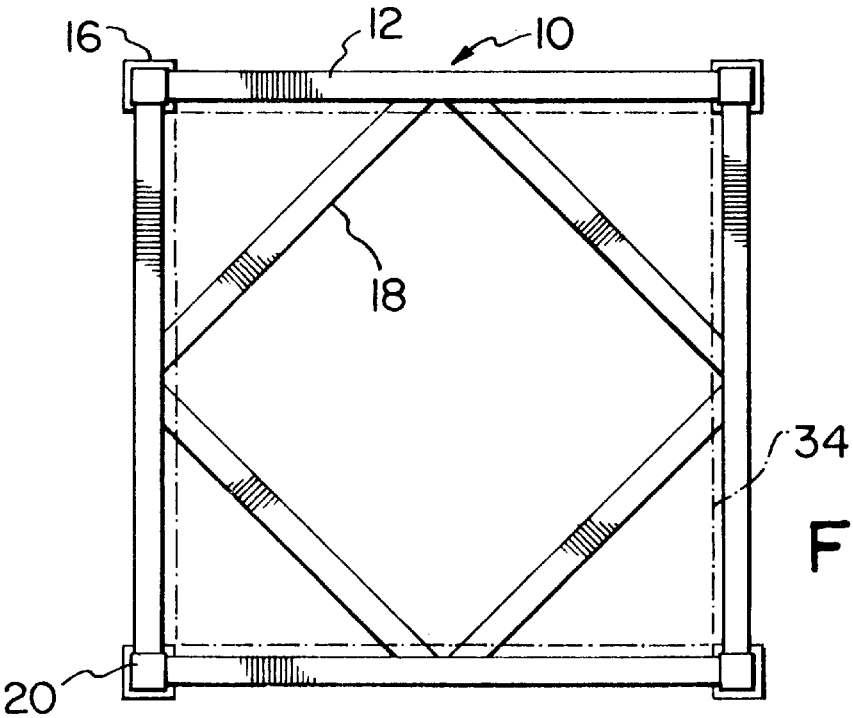
FIG. 2 shows a plan view on base of the present invention.

Referring now to drawings, FIGS. 1–4 show rack 10 comprising a support base 12 of generally quadrangular configuration having four side support members 14. The base 12 is provided with support legs 16 connected to each corner of the base 12. The base 12 is additionally provided with four reinforcement members 18 extending between adjacent side support members 14 thus forming a diamond-shaped central opening in the base 12. Each of the four reinforcement members 18 is placed under 45 degrees relative to the adjacent side support member 14, thus forming the hypotenuse of a right triangle. Such positioning of reinforcement members 18 allows to provide a larger free area or central opening inside the base 12 allowing to facilitate freely dispensing of items of smaller dimensions stored inside said rack downwardly through said central opening. Preferably but not necessarily, each end of the reinforcement member 18 is fixed near the middle section of the corresponding side support member 14. However, the present invention is not restricted to such an arrangement and any other possible equivalent positioning of said reinforcement members 18 may be used without departing from the scope of present invention. The base 12 is preferably made from a structural steel tubing and screen portions are made of heavy gauge welded steel mesh which are welded together by electric welding to form a unitary configuration.

The support legs 16 have a square cross-section, wherein upper ends of legs 16 have upwardly opening sockets 20 provided for sliding detachable posts 22 (also having a square cross-section of smaller dimensions) into them.

The first embodiment of the present invention (see FIG. 1) is similar to the modification shown on FIGS. 1–4 of my U.S. Pat. No. 4,199,069, and may be used for storage of pipes having dimensions longer than rack 10. In this modification, two sliding binders 24 are used to securely lock posts 22 of loaded rack by means of end square rings 26 formed at each end of the sliding binder 24. This arrangement of sliding binders serves to hold straight all posts in the following manner: during tiering of one rack upon another, all upper corners of posts 22 slide into the corresponding sockets (not shown) of the legs 16 of the sequential rack. Such a modification becomes a rack for holding goods in lengths, such as pipes, tubes, boards, skis, ducts, etc.

Figure 3:
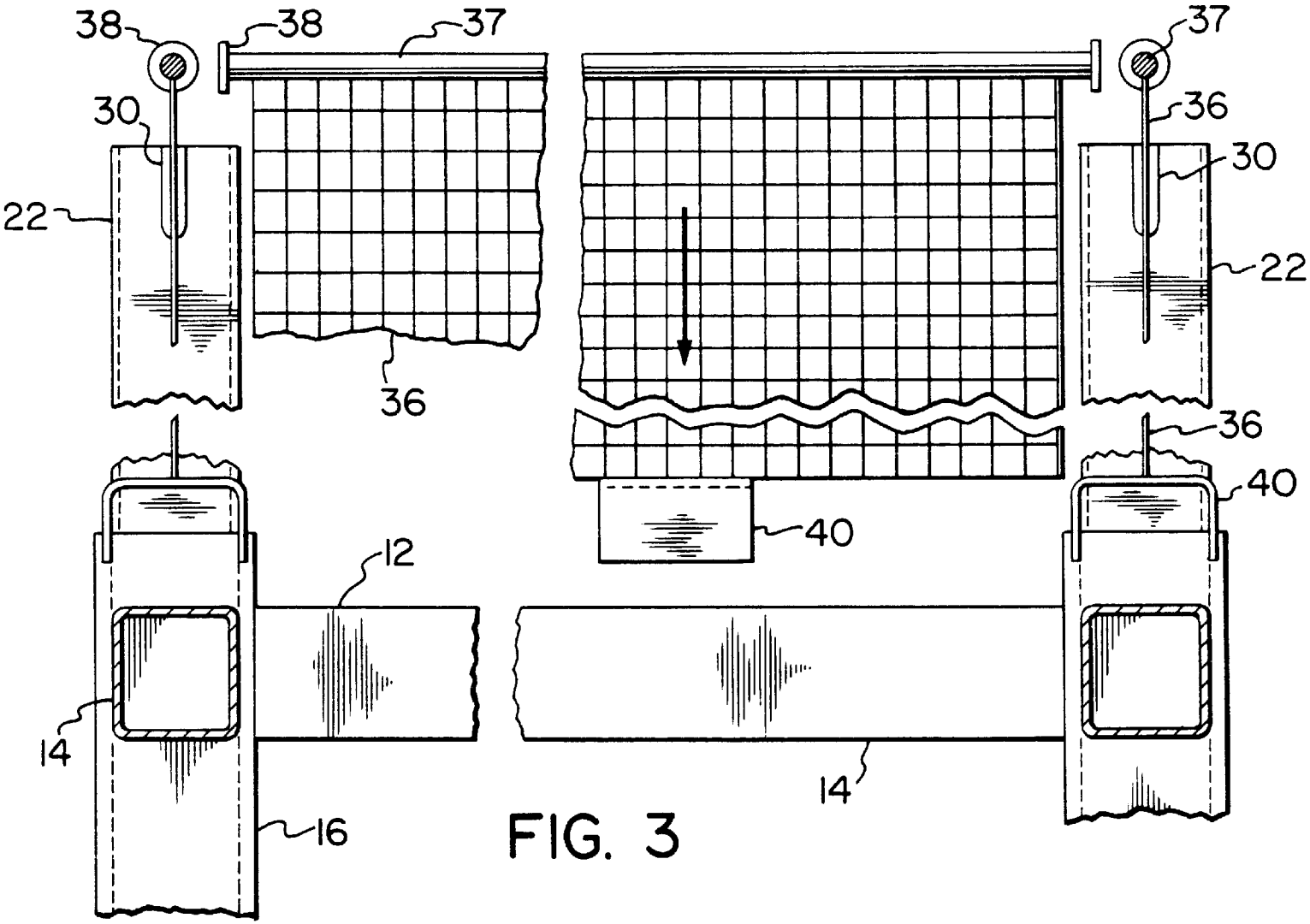
FIG. 3 shows a partial cross-sectional side view of the third modification of the present invention.
Figure 4:
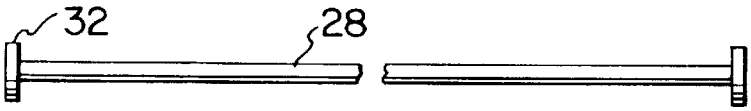
FIG. 4 shows a side view of a locking binder according the second modification of the present invention.
Figure 6A:
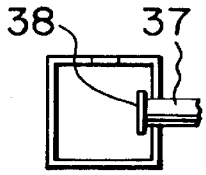
FIG. 6A shows a fragmental top view of FIG. 5 taken along lines A—A.
Figure 6B:
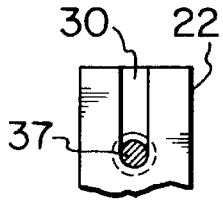
FIG. 6B shows a side view of FIG. 6A.
Figure 7:
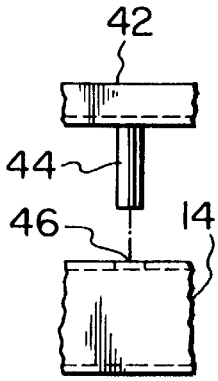
FIG. 7 shows an enlarged fragmental view of FIG. 5 depicting retaining pins.
Figure 5:
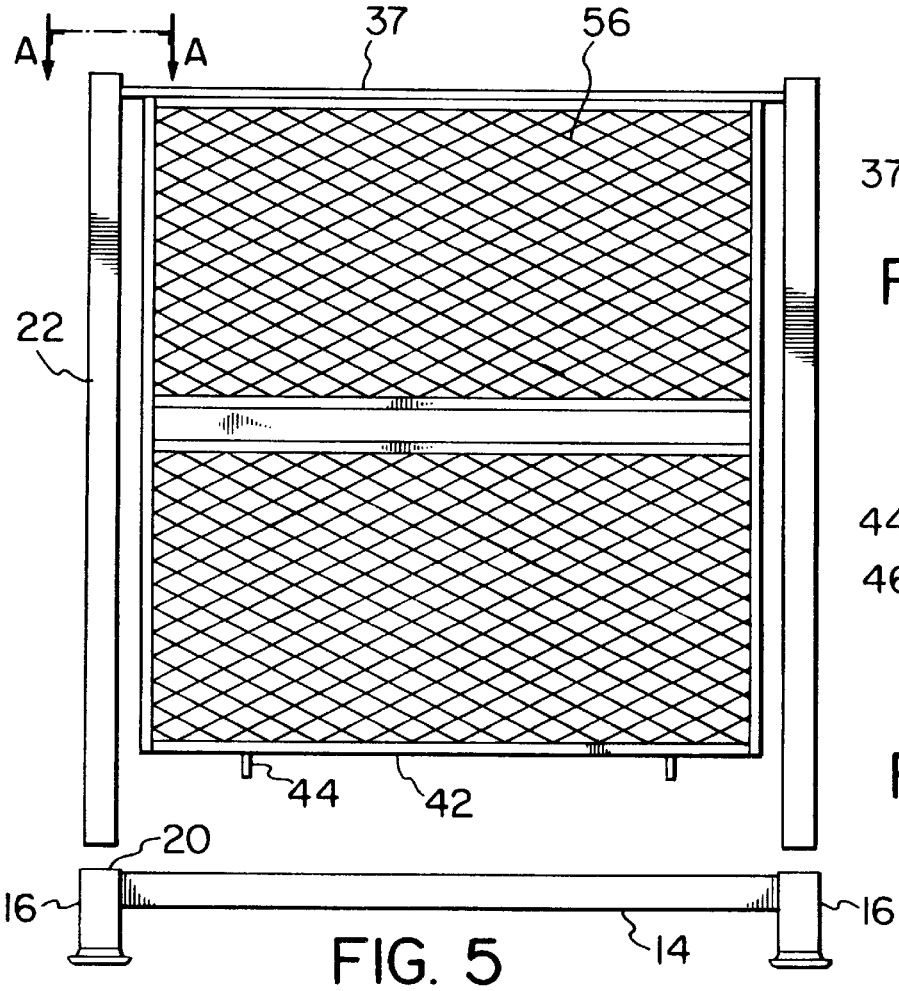
FIG. 5 shows alternative arrangement of the third modification of FIG. 3.
Figure 8:
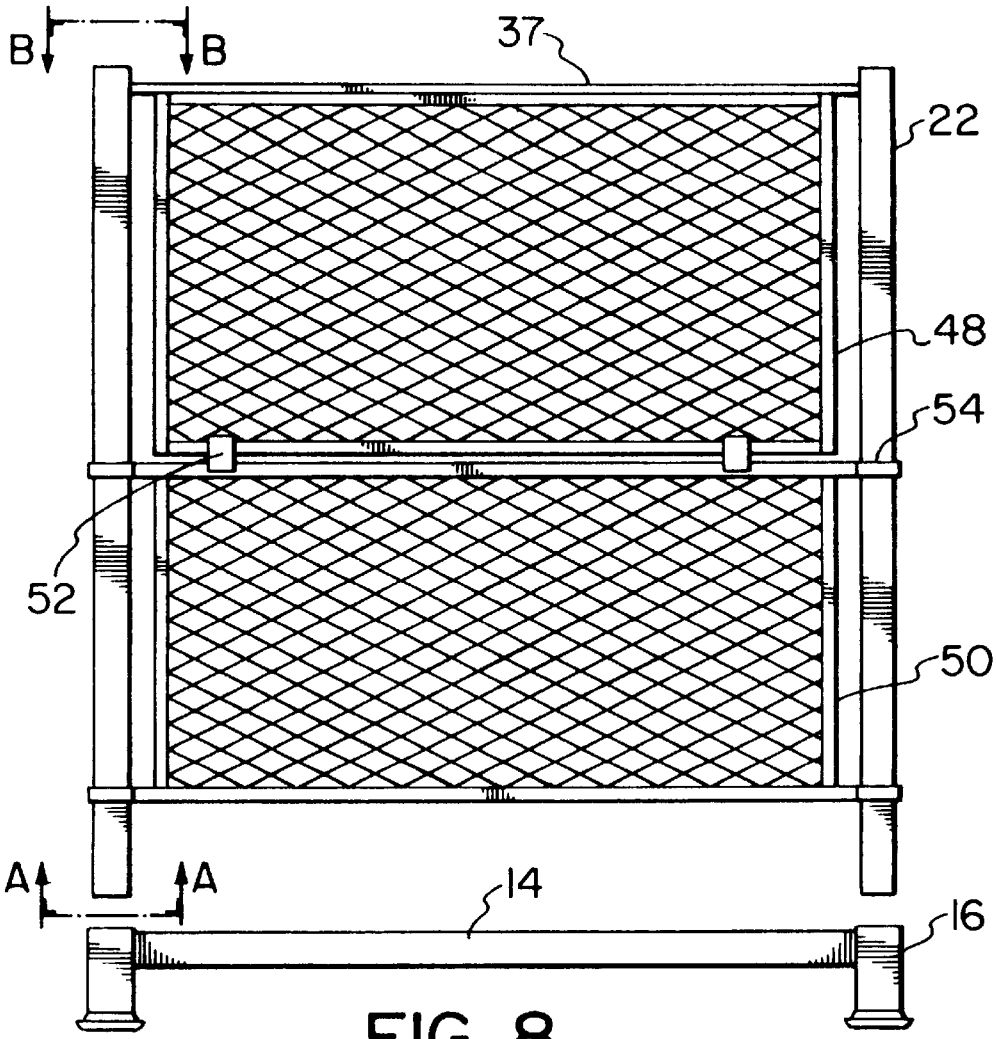
FIG. 8 shows a forth modification of the present invention.
Figure 9A:
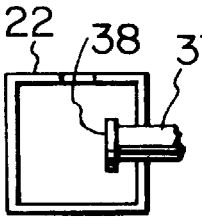
FIG. 9A shows a fragmental top view of FIG. 8 taken along lines B—B.
Figure 9B:
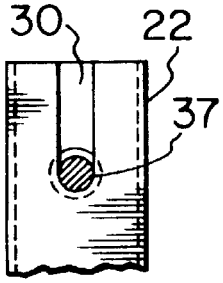
FIG. 9B shows a side view of FIG. 9A.
Figure 10A:
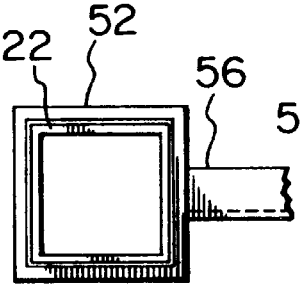
FIG. 10A shows a fragmental top view of FIG. 8 depicting square rings.
Figure 10B:
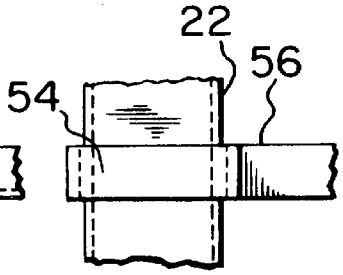
FIG. 10B shows a front view of FIG. 10A.
Figure 11A:
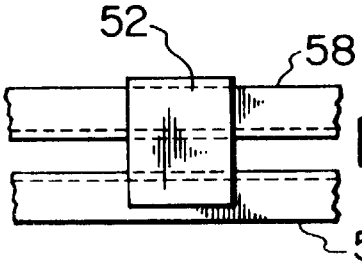
FIG. 11A shows a fragmental view of FIG. 8 depicting retaining brackets of the upper section.
Figure 11B:
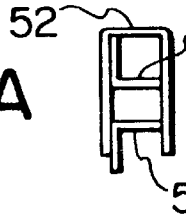
FIG. 11B shows a side view of FIG. 11A.

The second modification comprises the base 12 having posts 22 which are connected near the upper ends by means of locking binders 28 (see FIG. 4). In this modification, locking binders 28 are locked inside corresponding elongated vertical slots 30 formed along the upper portions of each post 22 (see FIG. 3). Locking binders 28 are locked inside slots 30 by means of locking elements 32 formed on each end of locking binder 28. The length and dimension of each slot 30 is designed to allow a limited sliding freedom of the locking element 32 inside the slot 30. Each rack is provided with a bottom plate 34 (shown in broken lines on FIG. 2) placed on top of base 12. Bottom plate 34 may be made of metal, plywood or any other similar material. The complete assembly may be enclosed with a stretch wrap (not shown) around posts 22 to become a container rack for holding lightweight goods, such as fittings for air distribution, sheet metal elbows, etc. In use, a number of racks 10 are then tiered in stacks. When the bottom rack is emptied, it can be easily refilled simply by sliding out the bottom plate 34 of the base 12 of the next rack 10 stacked on top. In view of the improved configuration of the base 12 provided with the central opening, the products can freely flow downwardly through the open base of upper rack into a lower rack. The process is followed up to the top rack which then becomes available as an empty rack.

The third modification (see FIG. 3) comprises the base 12, four posts 22 provided with slots 30 and four binder screens 36 mounted on posts 22 to form a container to hold goods or pieces of heavier nature. Upper portion of each binder screen 36 has a locking binder 37 provided with two locking elements 38 formed at each end of said locking binder 37. Said locking elements 38 are locked inside corresponding slots 30 of posts 22 in the manner similar to the second modification. The lower portion of each binder screen 36 is provided with a retaining U-shaped bracket 40 which is adapted to slide over the corresponding side support member 14 of base 12 to securely hold each binder screen 36 when in use. In view of the fact that locking elements 38 have a limited freedom to slidably move within the corresponding elongated slots 30, is possible to open each screen 36 of the assembly by its upward sliding motion allowing to disengage retaining bracket 40 from the side support member 14 and to swing out the screen 36. As in the second embodiment, each rack 10 is provided with bottom plate 34 allowing to transfer goods in the same manner as it was described in the second embodiment.

FIGS. 2–7 show an alternative arrangement of the third embodiment of FIG. 3 wherein instead of using the retaining bracket 40, the lower edge 42 of the screen 36 is provided with two pins 44 extending downwardly and provided to be accommodated within the corresponding openings 46 (see FIG. 7) of the side support member 14. FIGS. 6A and 6B illustrate in details how the locking binders 37 of the screen 36 are slidably locked within the corresponding slots 30 by means of locking elements 38.

FIGS. 8–11B show a fourth modification of the present invention comprising at least one vertical wall having a two-sectional configuration, wherein those sections are divided into an upper section 48 and a lower section 50. The upper section 48 is held on posts 22 by means of locking binders 37 provided with locking elements 38 (see FIGS. 9A and 9B) in the same manner as third embodiment of FIG. 3. The lower section 50 is slidably mounted on posts 22 by means of square rings 54 formed on each corner of the lower section 50 (see FIGS. 10A and 10B). The upper section 48 is securely retained on the lower section 50 by means of two retaining brackets 52 extending downwardly from a lower edge 58 of the upper section 48 to engage a corresponding upper edge 56 of the lower section 50 (see FIGS. 11A and 11B). The advantage of such two-sectional arrangement is the possibility to get access to the lower part of the rack by means of disengaging retaining brackets and swinging out the upper section 48 and then sliding upwardly the lower section 50. This feature of the fourth embodiment is particular useful when the rack is half-empty and it is necessary to reach items stored in the lower part of the rack.

Such arrangements of locking binders in the second, third and fourth embodiments allow to lock all upper corners of posts 22 for proper tiering of one rack on top of another.

Racks 10 of all embodiments could be stacked in the manner shown and described on FIG. 4 of U.S. Pat. No. 4,199,069.

The present invention has following advantages:

- better reinforcement of the base which assures that at any point the lifted load is equally divided to reduce strain and thus to provide better capacity;
- the new structure of the base prevents any distortion of the rack if the rack is hit at a corner by the forks of a lift truck or another similar device;
- even weight loading when using long products, such as pipes or bars, when they are loaded lengthwise or widthwise;
- allows building rack with lighter material and still maintain good loading capacity;
- allows to handle rack from all sides with a fork-lift truck;
- possibility of freely transferring products from top rack to the bottom rack due to the improved configuration of the base, which is an important feature in warehouses where it is crucial to have fast and easy handling and access to the products contained in the stack of racks.

Thus, it can be seen that the objects of the present invention have been satisfied by the structure presented hereinabove. While in accordance with the Patent Statutes, only the best mode and preferred embodiments of the present invention have been presented and described in detail, it is to be understood that the invention is not limited thereto or thereby. Accordingly, for an appreciation of the true scope and breadth of the invention, references should be made to the following claims.

What is claimed is:

1. A stackable carrying rack comprising:

a support base provided with support legs extending downwardly from said base;

vertical support means mounted on said base and provided for confining and storing a plurality of light-weight bulky items placed in said rack;

said support base has a generally square configuration formed by side support members, and wherein said support base has a wide-open central opening formed by reinforcement members extending between adjacent side support members;

said support base is further provided with a bottom plate placed over said support base, wherein said bottom plate together with said vertical support means is provided to confine and store the plurality of light-weight bulky items within said rack, and wherein said bottom plate is adapted to be slidably removed from said base;

wherein said wide-open central opening having dimensions for obstruction-free transferring of said light-weight bulky items downwardly from said rack through said central opening into an empty rack stacked below said rack when said bottom plate is slidably removed from said base;

wherein said vertical support means are securely supported in a vertical position by linking cross-pieces, and wherein each of said linking cross-pieces comprises a locking binder provided with a disk-shaped locking element on each end adapted to be slidably positioned within corresponding vertical slots formed along upper ends of said vertical support means.

2. A stackable carrying rack according to claim 1, wherein said central opening has a diamond-shaped configuration.

3. A stackable carrying rack according to claim 2, wherein each of said reinforcement members is positioned at an angle of less than 45 degrees with respect to each adjacent side support member.

4. A stackable carrying rack according to claim 2, wherein said vertical support means comprises vertical support posts mounted on each corner of said support base, and wherein each of said linking cross-pieces is provided to connect together a pair of adjacent posts.

5. A stackable carrying rack according to claim 2, wherein said vertical support means comprises vertical support posts mounted on each corner of said support base, said posts being securely linked and supported in vertical position by side wall sections provided to connect together a pair of adjacent posts by said locking binders located along an upper edge of each of said side wall sections.

6. A stackable carrying rack according to claim 5, wherein at least one of said side wall sections further comprises a lower locking means for mounting said side wall sections on said vertical posts located on lower portions of said side wall sections.

7. A stackable carrying rack according to claim 6, wherein said lower locking means comprises a retaining bracket adapted to be securely engaged with the corresponding side support member of said support base.

8. A stackable carrying rack according to claim 6, wherein said lower locking means comprises a pair of pins extending downwardly from a lower edge of each of said side wall sections, said pins are adapted to be inserted into corresponding openings formed within an upper edge of the side support members of said support base.

9. A stackable carrying rack according to claim 5, wherein at least one of said side wall sections comprises an upper section and a lower section.

10. A stackable carrying rack according to claim 9, wherein said lower section is slidably mounted on the adjacent posts by square rings located on each corner of said lower section and wherein said upper section is supported on said adjacent posts by said locking binders.

11. A stackable carrying rack according to claim 10, wherein said upper section is securely retained on said lower section by at least one retaining bracket adapted to engage an upper edge of said lower section.

12. A stackable carrying rack according to claim 5, wherein said side wall sections are formed from screen or mesh wire.

* * * * *